US008602741B2

(12) United States Patent
Ahmad et al.

(10) Patent No.: US 8,602,741 B2
(45) Date of Patent: Dec. 10, 2013

(54) TURBINE VANE FOR A STATIONARY GAS TURBINE

(75) Inventors: Fathi Ahmad, Kaarst (DE); Michael Dankert, Offenbach (DE); Günther Walz, Mülheim an der Ruhr (DE)

(73) Assignee: Siemens Aktiengesellscaft, Munich (DE)

( * ) Notice: Subject to any disclaimer, the term of this patent is extended or adjusted under 35 U.S.C. 154(b) by 574 days.

(21) Appl. No.: 12/919,265

(22) PCT Filed: Feb. 18, 2009

(86) PCT No.: PCT/EP2009/051909

§ 371 (c)(1),
(2), (4) Date: Aug. 25, 2010

(87) PCT Pub. No.: WO2009/106462

PCT Pub. Date: Sep. 3, 2009

(65) Prior Publication Data

US 2011/0033305 A1 Feb. 10, 2011

(30) Foreign Application Priority Data

Feb. 28, 2008 (EP) ..... 08003728

(51) Int. Cl.
*F01D 5/18* (2006.01)

(52) U.S. Cl.
USPC ..... 416/233

(58) Field of Classification Search
USPC ..... 416/233, 193 A, 95, 96 R, 96 A, 97 R
See application file for complete search history.

(56) References Cited

U.S. PATENT DOCUMENTS

| | | | | |
|---|---|---|---|---|
| 3,370,829 | A * | 2/1968 | Banthin et al. | 416/97 R |
| 5,716,192 | A * | 2/1998 | Phillips et al. | 415/115 |
| 7,713,027 | B2 * | 5/2010 | Cherolis et al. | 416/97 R |
| 2004/0096313 | A1 * | 5/2004 | Harvey et al. | 415/115 |
| 2005/0265844 | A1 | 12/2005 | Calderbank | |
| 2006/0083613 | A1 * | 4/2006 | Cunha et al. | 416/97 R |

FOREIGN PATENT DOCUMENTS

| | | | |
|---|---|---|---|
| CN | 1763352 | A | 4/2006 |
| EP | 1420142 | A1 | 5/2004 |
| GB | 2314125 | | 12/1997 |
| JP | 2001140601 | A * | 5/2001 |
| JP | 2005337258 | A | 12/2005 |
| JP | 2006112430 | A | 4/2006 |

* cited by examiner

*Primary Examiner* — Richard Edgar

(57) ABSTRACT

A turbine vane for a stationary gas turbine is provided. The turbine vane includes a hollow vane blade, wherein a rib is provided inside the vane blade to allow a pressure side wall and a suction side wall to support one another. The rib has an opening penetrating the rib near a wall at a height of an external fillet between a side wall, and a platform surface for extending a life of the turbine vane. By the opening, material accumulations in a transition region are avoided or the accumulation is reduced, whereby increases in stiffness and higher temperature gradients associated therewith are avoided.

13 Claims, 2 Drawing Sheets

TURBINE VANE FOR A STATIONARY GAS TURBINE

CROSS REFERENCE TO RELATED APPLICATIONS

This application is the U.S. National Stage of International Application No. PCT/EP2009/051909 filed Feb. 18, 2009, and claims the benefit thereof. The International Application claims the benefits of European Application No. 08003728.6 EP filed Feb. 28, 2008. All of the applications are incorporated by reference herein in their entirety.

FIELD OF INVENTION

The invention refers to a turbine blade for a stationary gas turbine, with at least one platform section which comprises a platform with a platform surface on which is arranged a blade airfoil which is profiled in cross section, having a pressure-side wall and a suction-side wall, wherein the surfaces of the pressure-side wall and of the suction-side wall which are exposable to a hot gas merge in each case into the platform surface via an outer rounding, and with at least one cavity which is arranged in the blade airfoil, extends into the platform section, and in which provision is made for at least one rib which connects the pressure-side wall to the suction-side wall and, extending along a longitudinal direction of the blade airfoil, sub-divides the cavity.

BACKGROUND OF INVENTION

Aforesaid turbine blades have been known for a long time from the prior art. As a rule, they have a blade airfoil which is traversed by cavities which are separated from each other by means of ribs. The ribs extend from the suction-side wall to the pressure-side wall and along the longitudinal direction of the blade airfoil, i.e. from the platform to the blade tip. Cast turbine blades in this case have a transition region between blade airfoil and platform surface which, by means of a fillet-like rounding, thickens the blade sidewalls, i.e. the suction-side wall and the pressure-side wall, in this region. In the transition region, therefore, there is a material accumulation which also brings with it a sudden change of rigidity of the blade airfoil. The blade airfoil is therefore stiffer on the platform side than in its middle region or on the blade-tip side. On account of this sudden change of rigidity, larger temperature gradients can occur during In order to avoid secondary damage in the gas turbine, in which such a turbine blade is installed and used during operation, as a result of fragments which become detached from the turbine blade, the turbine blade is exchanged after achieving a predetermined maximum service life.

From the prior art it is known, moreover, to at least partially extend the service life by a thicker thermal barrier coating being applied in the regions of sudden changes of rigidity than in the regions without such material accumulations. As a result, the temperature gradients can be reduced.

In addition, a gas turbine blade, the leading edge of which, exposable to inflow by a hot gas, is impingement cooled, is known from EP 1 420 142 A1. The impingement cooling openings which are required for this purpose are arranged in a rib which supports the blade airfoil between suction-side and pressure-side walls. In this case, the impingement cooling openings for the most part are distributed uniformly over the height of the blade airfoil and invariably arranged in the middle between pressure side and suction side in order to ensure uniform cooling of the leading edge.

SUMMARY OF INVENTION

It is therefore an object of the present invention to provide a turbine blade for a stationary gas turbine, which blade has an extended service life.

The object is achieved by means of a turbine blade according to the independent claims.

The invention provides that in a turbine blade which is referred to in the introduction at least one of the ribs which are arranged in the blade airfoil at the level of the outer rounding has an opening, off-center and close to the wall, which penetrates the rib.

The opening is provided at the level of the outer rounding inside the turbine blade in the rib which is arranged there. Close to the wall in this case can mean that its position is off-center between the inner sides of pressure-side wall and suction-side wall. As a result of this, the material accumulation at the level of the outer rounding can be reduced. This simple constructional means leads to balancing of the sudden change of rigidity and to the reduction of the temperature gradient in the then-reduced material accumulation. If necessary, the effects which are induced by the opening upon the cooling air system of the turbine blade, and also upon the stress increase around the opening, are additionally to be taken into consideration. The same applies to the so-called creep life as a result of the reduced supporting cross section of the rib and to the possibly altered natural frequencies on account of the mass which is then absent. Consequently, it may be wise to provide an oval opening with a suitable orientation. Extending the rib into the platform section and furthermore onto the root section or fastening section of the turbine blade may also be wise.

According to a further advantageous development, accommodating a further rounding which is arranged between rib and sidewall may also be wise. As a result of this, mechanical loads are reduced. Naturally, the proposed measures can also be combined in order to compensate the changes which occur as a result of using the opening close to the wall in order to achieve overall an extended service life of the turbine blade. In all, with the invention the load on the material accumulation can be reduced and therefore the service life can be increased.

The measure according to the invention to make provision in the rib, at the level of the outer rounding, for an opening which is close to the wall and penetrates the rib, can be simply realized and can also be subsequently retrofitted in operationally stressed turbine blades as long as accessibility to the rib through the blade root is ensured. On the other hand, the opening can be achieved in a simple way during the production of new parts if the blade airfoil and the platform are cast in one piece and the casting core, which is used for producing the cavities in the casting device, for the subsequent opening close to the wall which is provided in the rib, is realized by means of a hole which is provided in the core. This is particularly advantageous since the hole can also be used for stabilizing the casting core, and other so-called crossover holes, which are provided neither close to the wall nor at the level of the outer rounding in a rib which is arranged between the suction-side wall and the pressure-side wall, can be dispensed with.

Advantageous developments and further developments are disclosed in the dependent claims.

An opening which penetrates the rib is not only close to the wall when it is arranged off-center between suction-side wall and pressure-side wall but also when it is tangent to, or intersects, the sidewall plane which is spanned by the inner side of the suction-side wall and/or pressure-side wall.

The opening is expediently round or oval. These openings can be produced in a particularly simple manner, especially if the turbine blade is cast essentially in one piece. A casting core then only needs to have a corresponding hole at the corresponding place.

According to an alternative solution, the service life of a turbine blade can also be extended by the platform-side rib end extending by a longer or shorter distance on the inner side of the pressure-side wall than on the inner side of the suction-side wall.

A recess instead of the opening close to the wall and penetrating the rib is understood by this, i.e. the opening is not fully encompassed by rib material. Also, with a turbine blade which is equipped in such a way the mass accumulation in the transition region can be locally reduced. The turbine blade according to the second configuration, in an advantageous development, can have a platform surface which is part of an imaginary platform plane which extends through the cavity, wherein the platform-side end of the rib lies on the pressure side on one side of the platform plane and lies on the suction side on the other side of the platform plane.

BRIEF DESCRIPTION OF THE DRAWINGS

Further features, characteristics and advantages of the present invention are described in more detail in the following text based on exemplary embodiments with reference to the attached figures. The described features can be advantageous both individually and in combination with each other.

DETAILED DESCRIPTION OF INVENTION

Figure 1:
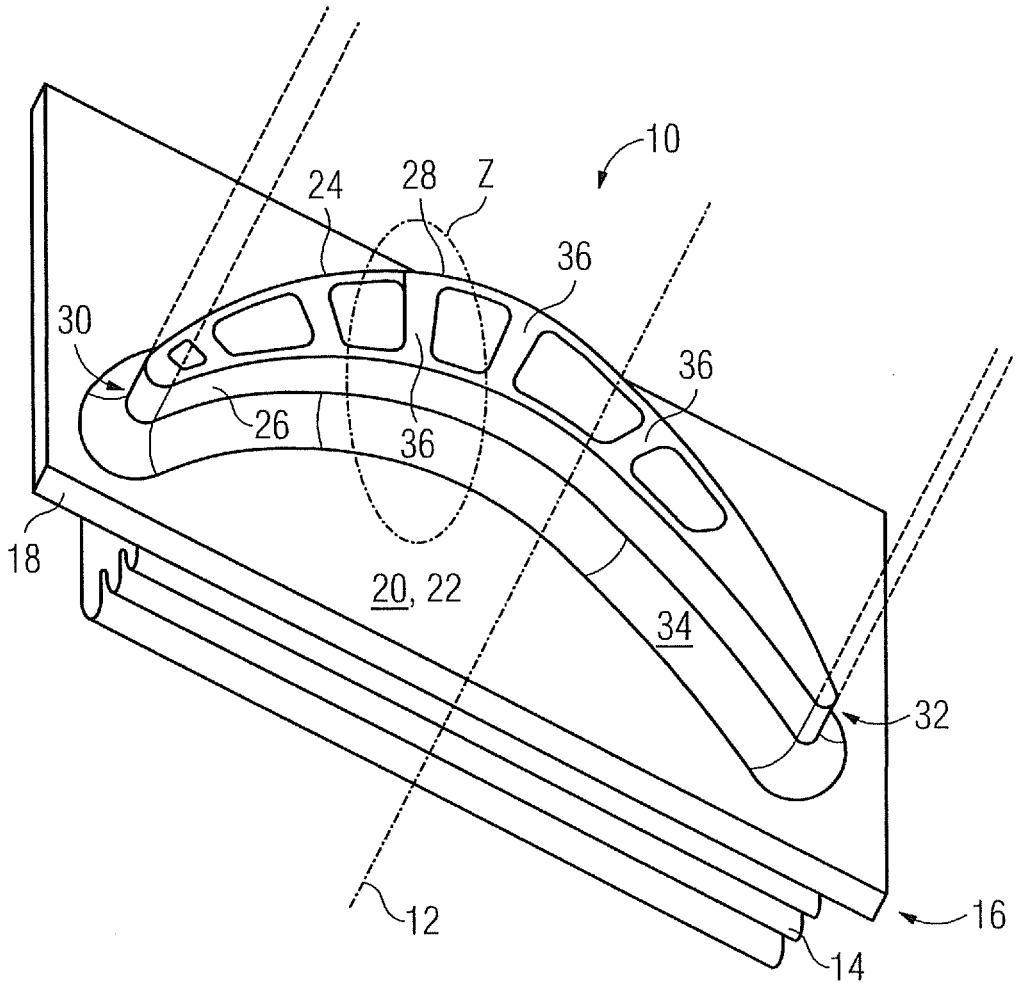
FIG. 1 shows a perspective view of a turbine blade according to the invention with a schematically represented blade airfoil.

FIG. 1 shows in a perspective view a turbine blade 10 for a stationary gas turbine. The turbine blade 10 according to FIG. 1 is formed as a rotor blade. The invention, however, can also be used in stator blades of a stationary gas turbine. The cast, one-piece turbine blade 10 comprises a blade root 14 along a longitudinal direction 12, to which is connected a platform section 16. The platform section 16 essentially comprises a platform 18 with a platform surface 20. The platform surface 20 is essentially planar and is therefore part of an imaginary platform plane 22. A blade airfoil 24, which is profiled in cross section, is arranged on the platform surface 20. The blade airfoil 24 is formed by a pressure-side wall 26 and a suction-side wall 28 which extend from a common leading edge 30 to a common trailing edge 32 and merge into each other both at the leading edge 30 and at the trailing edge 32 in the process. The surfaces of the suction-side wall 28 and pressure-side wall 26, and also the platform surface 20, in this case are passed by a hot gas of the gas turbine. Both the pressure-side wall 26 and the suction-side wall 28 merge into the platform 18 via a fillet-like, encompassing rounding 34. The rounding 34 or the transition section is also known as a fillet.

The cavity which is enclosed by the sidewalls 26, 28 is sub-divided into sub-cavities by means of a plurality of ribs 36. Each rib 36, at least inside the blade airfoil 24, extends along its longitudinal direction 12. In FIG. 1, only a stub of the blade airfoil 24 is shown. The complete blade airfoil up to the blade tip is only indicated by means of a broken line.

Figure 2:
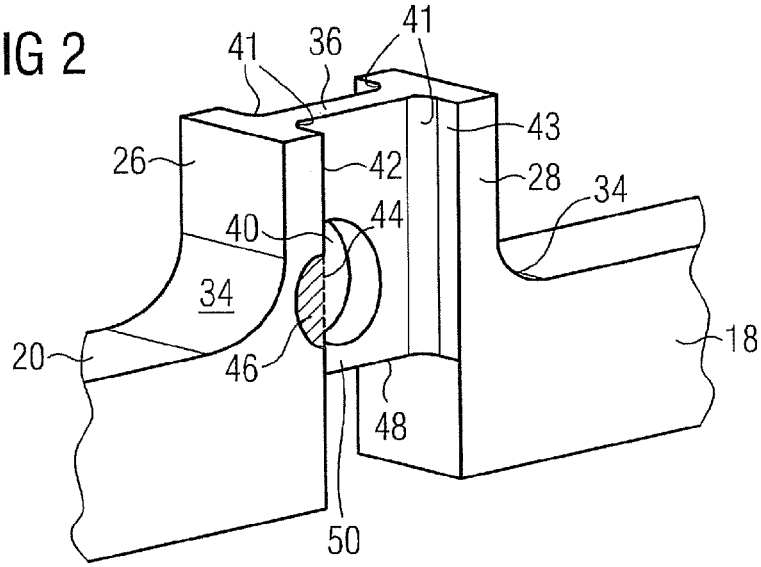
FIG. 2 shows the detail Z as a detail from the turbine blade according to the invention according to FIG. 1 in a perspective view.

FIG. 2 shows the detail Z of the turbine blade 10 according to FIG. 1 in a perspective view, wherein for reasons of clarity irrelevant elements in the direction towards the leading edge 30 and trailing edge 32 are blanked out. FIG. 2 shows in detail the features which are already described in relation to FIG. 1, these being the platform surface 20, the pressure-side wall 26, the suction-side wall 28, the platform 18, the rib 36 and the rounding 34.

According to the invention, provision is made in the rib 36, as viewed along the longitudinal direction 12 of the blade airfoil 24, for an opening 40 close to the wall, which penetrates the rib 36 and is at the level of the outer rounding 34. The opening 40 close to the wall is round in construction in the configuration which is shown. An oval opening 40 is also possible. The opening 40, with regard to an inner side 42 of the pressure-side wall 26, is arranged in such a way that the sidewall plane 44 which is spanned by it is intersected by the opening 40. Hereby, a material reduction, which is shown by hatching and provided with the designation 46, results in the region of the outer rounding 34. On account of the material reduction in the region of the outer rounding 34 inside the turbine blade 10, a sudden change of rigidity can be avoided since the mass increase in the region of the outer rounding 34 is compensated at least partially on account of the recess which exists as a result of the opening 40. On account of the opening 40 which exists in the rib 36, a bridge 50 remains with regard to the rib end 48 and connects the suction-side wall 28 to the pressure-side wall 26.

Figure 3:
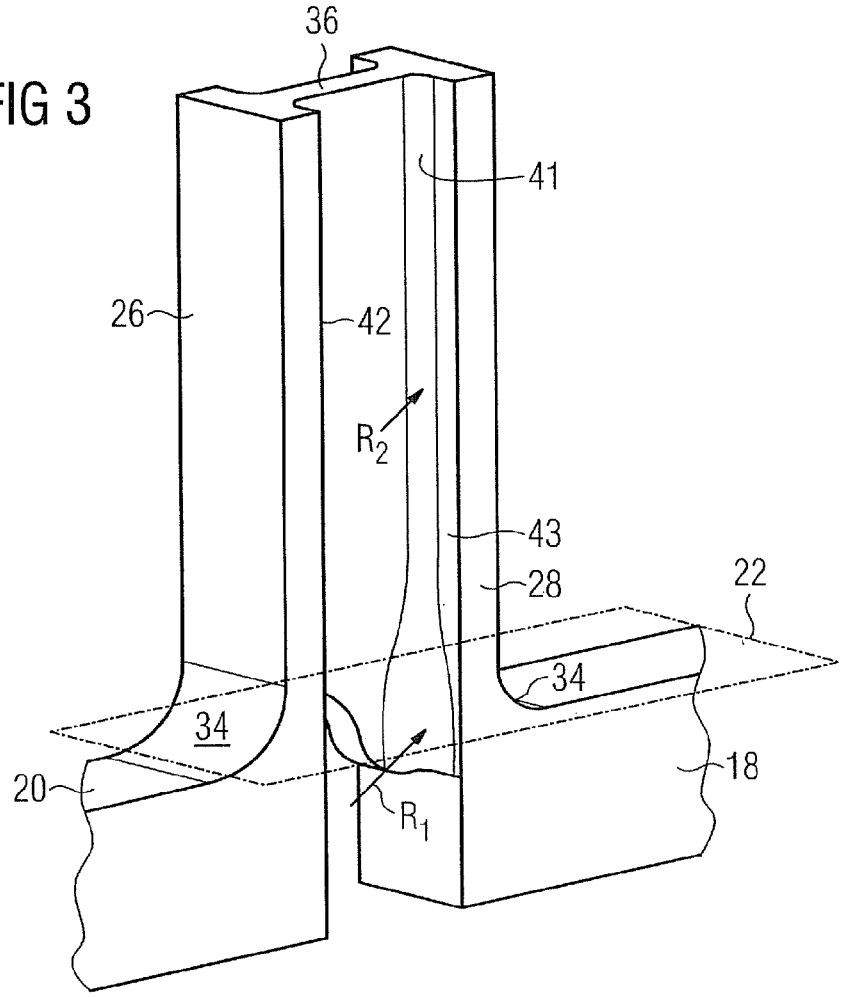
FIG. 3 shows the detail Z with an alternative solution.

The effect according to the invention can also be achieved with a turbine blade 10 in which there is no bridge 50. This results in an alternative turbine blade 10, the detail Z of which is shown in FIG. 3. The detail Z which is shown in FIG. 3 essentially corresponds essentially to the detail which is referred to in FIG. 2 and is therefore not described in more detail in this case. Identical features are provided with identical designations in FIG. 3. In contrast to FIG. 2, no provision is made in the rib 36 for an opening 40 which is entirely enclosed by material. Instead, on the platform side the rib 36 ends at a non-consistent height with regard to the longitudinal extent of the turbine blade 10. Therefore, instead of the opening 40 provision is made for a recess. That part of the rib 36 which is arranged directly on the inner side 43 of the suction-side wall 28 ends at a different point, as seen in the longitudinal direction of the blade axis 12, to that part of the rib 36 which is arranged directly on the inner side 42 of the pressure-side wall 26. In other words, the platform-side rib end extends far less on the inner side 42 of the pressure-side wall 26 than the rib end which is arranged on the inner side 43 of the suction-side wall 28. An unnecessary mass accumulation, which leads to an unnecessary sudden change of rigidity, can therefore be avoided at least for the pressure-side section of the outer rounding 34.

The platform surface 20 is part of an imaginary platform plane 22 which extends through the cavity. Preferably, the platform-side end of the rib 36 is arranged on the pressure side on one side, i.e. above (on the blade tip side) the platform plane 22, and is arranged on the pressure side on the other side, i.e. below (blade root side) the platform plane 22. Also, a reverse arrangement of the rib ends is possible, in which on the platform side the pressure-side end of the rib 36 ends beneath the platform plane 22 and the suction-side end of the rib 36 ends above the platform plane 22. The manner of the course of the platform-side rib end from the pressure side 26 to the suction side 28 can be optionally formed in this case.

The course can be for example in a straight line or, like the configuration shown in FIG. 3, can be convex/concave. In order to take into consideration the effects upon the cooling air system and also upon the stress situation in the opening 40 which arise as a result of using the opening 40 or recess according to the invention, an additional rounding 41, which is provided in the transition from rib 36 to inner wall 42, 43 of the pressure-side wall 26 and/or suction-side wall 28, can preferably also be accommodated. The accommodation leads to different radii R1, R2 for the additional rounding 41 at different positions along the longitudinal extent 12 of the blade airfoil 24. The radius R1 of the additional rounding 41 can be greater at the level of the outer rounding 34 than the radius R2 of the additional rounding 41 at mid-height of the blade airfoil 24.

As long as the ribs 36 are arranged in the middle region between leading edge 30 and trailing edge 32 of the blade airfoil 24, the opening 40 or recess is provided on the pressure-side wall. If, however the rib 36 is located comparatively close to the leading edge 30 or comparatively close to the trailing edge 32, then the opening 40 or the recess according to the invention can be arranged on the suction-side wall since higher hot gas temperatures and material temperatures occur in the corresponding regions.

The recess at the level of the outer rounding 34, which is brought about by the opening 40 in the inner side 42 of the pressure-side wall 26 or in the inner side 43 of the suction-side wall 28, can extend further along the inner side 42, 43 even beyond the region of the rib 36 so that the recess on the inner side is also arranged in the section of the transition region where no rib 36 supports the sidewalls 26, 28. The recess deepens the associated spanned plane of the sidewalls 26, 28 in the manner of a fillet in each case, as a result of which a mass reduction can also be achieved in the section of the outer rounding 34 in which there is no arrangement for a rib 36. This recess can also be used in the case of a turbine blade which is formed according to FIG. 3. In this case also, stress reductions according to the invention can therefore be achieved, which allows the occurrence of crack development and possibly crack propagation in this section of the transition region to be further delayed.

In all, the invention refers to a turbine blade 10 for a stationary gas turbine which has a hollow blade airfoil 24 in which there is at least one rib 36 inside, mutually supporting the pressure-side wall 26 and the suction-side wall 28, in which rib provision is made at the level of the outer rounding 34 between sidewall 26, 28 and platform surface 20 for an opening 40 close to the wall, penetrating the rib 36, for extending the service life of the turbine blade 10. By means of the opening 40, material accumulations in the transition region are avoided or the accumulation is reduced in comparison to when there is no opening 40, as a result of which sudden changes of rigidity and the larger temperature gradients which are associated therewith can be avoided.

The invention claimed is:

1. A turbine blade for a stationary gas turbine, the turbine blade comprising:

a platform section connected to a fastening section, the platform section comprising a platform with a platform surface, a blade being arranged on the platform surface, the blade being profiled in a cross section and including a pressure-side wall and a suction-side wall;

an outer rounding, wherein surfaces of the pressure-side wall and of the suction-side wall, which are exposable to a hot gas, merge into the platform surface via the outer rounding;

a cavity arranged in the blade and extending into the platform section; and a rib which connects the pressure-side wall to the suction-side wall, the rib being arranged in the cavity, and the rib sub-dividing the cavity along a longitudinal direction of the blade, wherein, at a level of the outer rounding, a platform-side rib end extends by a different distance on an inner side of the pressure-side wall than on an inner side of the suction-side wall, wherein the platform surface is part of an imaginary platform plane which extends through the cavity, and wherein the platform-side end of the rib lies on a pressure side on one side of the platform plane and lies on a suction side on the other side of the platform plane.

2. The turbine blade as claimed in claim 1, wherein the blade and the platform are cast in one piece.

3. The turbine blade as claimed in claim 1, wherein at the level of the outer rounding, the platform-side rib end extends by a shorter distance on the inner side of the pressure-side wall than on the inner side of the suction-side wall.

4. The turbine blade as claimed in claim 1, wherein at the level of the outer rounding, the platform-side rib end extends by a longer distance on the inner side of the pressure-side wall than on the inner side of the suction-side wall.

5. The turbine blade as claimed in claim 4, wherein at the level of the outer rounding, the platform-side rib end on the inner side of the pressure-side wall extends into the platform.

6. The turbine blade as claimed in claim 1, wherein at the level of the outer rounding, the platform-side rib end on the inner side of the suction-side wall extends into the platform.

7. A turbine blade for a stationary gas turbine, the turbine blade comprising:

a platform section connected to a fastening section, the platform section comprising a platform with a platform surface, a blade being arranged on the platform surface, the blade being profiled in a cross section and including a pressure-side wall and a suction-side wall;

an outer rounding, wherein surfaces of the pressure-side wall and of the suction-side wall, which are exposable to a hot gas, merge into the platform surface via the outer rounding;

a cavity arranged in the blade and extending into the platform section; and a rib which connects the pressure-side wall to the suction-side wall, the rib being arranged in the cavity, and the rib sub-dividing the cavity along a longitudinal direction of the blade, an opening penetrating the rib at the level of the outer rounding, wherein the opening is arranged off-center such that the opening is proximal to one sidewall than to other sidewall, wherein the rib merges into an inner side of the suction-side wall and/or into an inner side of the pressure-side wall via an additional rounding, and wherein the additional rounding has a first radius at a level of the platform and a second radius at another region located above the level of the platform, and wherein the first radius is different from the second radius.

8. The turbine blade as claimed in claim 7, wherein a transition of the additional rounding to radii of different sizes is smooth.

9. The turbine blade as claimed in claim 7, wherein the second radius ($R_2$) is the radius of the additional rounding at mid-height of the blade, and wherein the first radius is greater than the second radius.

10. The turbine blade as claimed in claim 7, wherein the blade and the platform are cast in one piece.

11. A turbine blade for a stationary gas turbine, the turbine blade comprising:

a platform section connected to a fastening section, the platform section comprising a platform with a platform surface, a blade being arranged on the platform surface, the blade being profiled in a cross section and including a pressure-side wall and a suction-side wall;

an outer rounding, wherein surfaces of the pressure-side wall and of the suction-side wall, which are exposable to a hot gas, merge into the platform surface via the outer rounding;

a cavity arranged in the blade and extending into the platform section; and a rib which connects the pressure-side wall to the suction-side wall, the rib being arranged in the cavity, and the rib sub-dividing the cavity along a longitudinal direction of the blade, wherein, at a level of the outer rounding, a platform-side rib end extends by a different distance on an inner side of the pressure-side wall than on an inner side of the suction-side wall, wherein at the level of the outer rounding, the platform-side rib end extends by a shorter distance on the inner side of the pressure-side wall than on the inner side of the suction-side wall, and wherein at the level of the outer rounding, the platform-side rib end on the inner side of the suction-side wall extends into the platform.

12. The turbine blade as claimed in claim 11, wherein the blade and the platform are cast in one piece.

13. The turbine blade as claimed in claim 11, wherein the platform surface is part of an imaginary platform plane which extends through the cavity, and wherein the platform-side end of the rib lies on a pressure side on one side of the platform plane and lies on a suction side on the other side of the platform plane.

* * * * *